US009648932B2

(12) United States Patent
Johnson et al.

(10) Patent No.: US 9,648,932 B2
(45) Date of Patent: May 16, 2017

(54) INTERCHANGEABLE POCKET SYSTEM FOR HANDBAGS

(75) Inventors: Christy Anne Johnson, Columbus, OH (US); Brandi Lynn Osterman, Dublin, OH (US)

(73) Assignee: Jewell LLC, Columbus, OH (US)

( * ) Notice: Subject to any disclaimer, the term of this patent is extended or adjusted under 35 U.S.C. 154(b) by 152 days.

(21) Appl. No.: 13/592,459

(22) Filed: Aug. 23, 2012

(65) Prior Publication Data

US 2014/0053960 A1 Feb. 27, 2014

(51) Int. Cl.
*A45C 3/06* (2006.01)
*A45C 13/02* (2006.01)

(52) U.S. Cl.
CPC ..... *A45C 3/06* (2013.01); *A45C 2013/026* (2013.01)

(58) Field of Classification Search
USPC ..... 150/113; 190/110
See application file for complete search history.

(56) References Cited

U.S. PATENT DOCUMENTS 1,764,483 A * 6/1930 Watkins ..... A41D 13/0012 2/247
4,260,004 A 4/1981 Domke
4,265,286 A * 5/1981 Rapoport ..... A45C 3/02 190/108
4,754,790 A 7/1988 Meyers
5,207,303 A * 5/1993 Oswalt et al. ..... 190/108
D403,863 S 1/1999 Briganti
D408,146 S 4/1999 Briganti
5,894,975 A 4/1999 Holden et al.
5,983,969 A 11/1999 Morgan
6,003,573 A 12/1999 Owens
6,179,025 B1 1/2001 Sutton
6,237,660 B1 5/2001 Giardino
6,334,519 B1 * 1/2002 Tong ..... A45C 3/00 190/107
6,446,688 B1 9/2002 Sutton
6,668,882 B1 12/2003 Cazes
(Continued)

FOREIGN PATENT DOCUMENTS

JP 08168408 A * 7/1996 ..... A45C 3/00
JP 08196321 A * 8/1996 ..... A45C 3/00
JP 2005-153866 A * 6/2005

*Primary Examiner* — Tri Mai
(74) *Attorney, Agent, or Firm* — Porter, Wright, Morris & Arthur, LLP

(57) ABSTRACT

A handbag includes a body forming an interior compartment and an opening for accessing the interior compartment, a first hanger within the interior compartment, a second hanger within the interior compartment, a first pocket assembly removably secured to the first hanger so that the first pocket assembly hangs from the first hanger within the interior compartment and is accessible through the opening, and a second pocket assembly removably secured to the second hanger so that the second pocket assembly hangs from the second hanger within the interior compartment and is accessible through the opening. The first and second pocket assemblies are interchangeable with other pocket assemblies to easily configure the interior compartment in any desired manner for storage and they are also interchangeable with other handbags so that items stored in the pockets assemblies can be easily transferred to other handbags.

13 Claims, 13 Drawing Sheets

(56) References Cited

U.S. PATENT DOCUMENTS

| | | | | |
|---|---|---|---|---|
| 6,796,344 | B2 | 9/2004 | Chen et al. | |
| 6,823,909 | B1 | 11/2004 | Marsteller | |
| 7,086,437 | B1 | 8/2006 | Michael | |
| 7,293,635 | B2 | 11/2007 | Repke et al. | |
| 7,301,757 | B2 * | 11/2007 | Lee et al. | 361/679.27 |
| 7,461,676 | B2 | 12/2008 | Huie | |
| D595,957 | S | 7/2009 | Meyers | |
| D600,918 | S | 9/2009 | Carlevale | |
| 7,607,461 | B2 | 10/2009 | Pace et al. | |
| 7,628,187 | B2 | 12/2009 | Mittelstaedt | |
| D610,801 | S | 3/2010 | Romero et al. | |
| D611,705 | S | 3/2010 | Romero et al. | |
| D613,062 | S | 4/2010 | Romero et al. | |
| D618,913 | S | 7/2010 | Helmhout | |
| 7,789,114 | B2 * | 9/2010 | Pace et al. | 150/105 |
| 7,900,757 | B2 | 3/2011 | Sisitsky | |
| D636,988 | S | 5/2011 | Romero et al. | |
| D637,399 | S | 5/2011 | Romero et al. | |
| D637,810 | S | 5/2011 | Romero et al. | |
| D638,627 | S | 5/2011 | Romero et al. | |
| 7,942,296 | B1 | 5/2011 | Johnson | |
| D639,551 | S | 6/2011 | Romero et al. | |
| D640,871 | S | 7/2011 | Romero et al. | |
| 2006/0021684 | A1 | 2/2006 | DeCoro, III | |
| 2007/0102077 | A1 | 5/2007 | Parker-Ogden | |
| 2008/0135144 | A1 | 6/2008 | Brody | |
| 2008/0230158 | A1 | 9/2008 | Romero et al. | |
| 2008/0237068 | A1 | 10/2008 | Melamed | |
| 2009/0084475 | A1 | 4/2009 | Dean-Perry | |
| 2009/0183806 | A1 | 7/2009 | Foster et al. | |
| 2010/0218863 | A1 | 9/2010 | Church et al. | |

* cited by examiner

INTERCHANGEABLE POCKET SYSTEM FOR HANDBAGS

CROSS-REFERENCE TO RELATED APPLICATIONS

Not Applicable

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE INVENTION

The field of the present invention generally relates to handbags and, more particularly, to handbags having an interchangeable pocket system.

BACKGROUND OF THE INVENTION

While handbags or purses are useful for carrying items, they are often purchased due to their aesthetic appeal or to suit a particular outfit. When choosing a handbag based on the aesthetic appeal of its exterior, the handbag may not have an interior configuration that provides the functionality desired by the purchaser. Handbags typically have one or more interior pockets or storage elements within the interior of the handbag for holding personal items in an organized manner, but a particular handbag may not have a desired quantity, type, and/or size of interior pockets or storage elements. However, when choosing a handbag based on its interior configuration, the handbag may not have the exterior aesthetic appeal desired by the purchaser. Furthermore, the desired functionality of the handbag frequently changes depending on the occasion or use such as, for example, work, nightlife, etc. As a result, the purchaser must often compromise on one or more aspects of the handbag when making a purchase.

Most women purchase multiple handbags having different aesthetics and functional configurations to suit different outfits and/or different occasions. However, using several different handbags can cause logistical issues based on switching personal items between the handbags. For example, anytime a user wants to use a different handbag for whatever reason, the user needs to spend time transferring personal items from one handbag to another. This can also result in the confusion of having various items in several different handbags.

One attempt to solve some of these problems was to provide a handbag with removable covers, skirts, or the like on the exterior of the handbag. When it is desired to change the exterior aesthetic appearance of the handbag, the cover is simple removed and replaced with a cover having a different aesthetic appearance. While these removable covers can change the exterior aesthetic appearance of the handbags, they do not change the style of handbag or the interior configuration of the handbag.

Another attempt to solve some of these problems was to provide a handbag with a removable insert or organizer within the interior of the handbag which can be moved from one handbag to another. This is sometimes referred to as "a purse within a purse." While these inserts can make it easier to move personal items from one handbag to another, they do not change the interior configuration of the handbag unless more than one insert is utilized which defeats the purpose because the personal items must then be transferred between the various inserts.

Accordingly, there is a need in the industry for an improved handbag and/or handbag system.

SUMMARY OF THE INVENTION

Disclosed are handbags that overcome at least one deficiency of the prior art handbags described above. Disclosed is a handbag comprising, in combination, a body forming an interior compartment and an opening for accessing the interior compartment, a first hanger secured to the body within the interior compartment, a second hanger secured to the body within the interior compartment, a first pocket assembly removably secured to the first hanger with a plurality of first fasteners so that the first pocket assembly hangs from the first hanger within the interior compartment and is accessible through the opening, and a second pocket assembly removably secured to the second hanger with a plurality of second fasteners so that the second pocket assembly hangs from the second hanger within the interior compartment and is accessible through the opening. The first and second pocket assemblies each form at least one pocket for storage.

Also disclosed is a handbag system comprising, in combination, a handbag and first, second, and third pocket assemblies interchangeably secured within the handbag. The handbag comprises a body forming an interior compartment and an opening for accessing the interior compartment, a first hanger secured to the body within the interior compartment, and a second hanger secured to the body within the interior compartment. The first, second, and third pocket assemblies are interchangeably secured to the first hanger to hang from the first hanger within the interior compartment and be accessible through the opening and interchangeably secured to the second hanger to hang from the second hanger within the interior compartment and be accessible through the opening. The first, second, and third pocket assemblies each form at least one pocket for storage.

Also disclosed is a handbag comprising, in combination, a body forming an interior compartment and an opening for accessing the interior compartment, a first hanger secured to the body within the interior compartment near the opening, a second hanger secured to the body within the interior compartment near the opening, a first pocket assembly removably secured to the first hanger with a plurality of first fasteners so that the first pocket assembly hangs from the first hanger within the interior compartment and is accessible through the opening, and a second pocket assembly removably secured to the second hanger with a plurality of second fasteners so that the second pocket assembly hangs from the second hanger within the interior compartment and is accessible through the opening. The body has opposed first and second sides, and the first hanger is secured to the first side and the second hanger is secured to the second side opposed to the first hanger. The first and second hangers are each rectangular shaped having upper and lower edges and the first and second hangers are each secured to the body near the upper edge so that the lower edge is generally pivotable upward about the upper edge. The first pocket system is secured to and supported by only the first hanger and the second pocket is secured to and supported by only the second hanger. The first and second pocket assemblies each form at least one pocket for storage.

From the foregoing disclosure and the following more detailed description of various preferred embodiments it will be apparent to those skilled in the art that the present invention provides a significant advance in the technology and art of handbags and the like. Particularly significant in this regard is the potential the invention affords for a pocket system that is relatively easy to use, relatively inexpensive to produce and assemble, customizable to produce desired interior configurations, and interchangeable between handbags. Additional features and advantages of various embodiments of the invention will be better understood in view of the detailed description provided below.

BRIEF DESCRIPTION OF THE DRAWINGS

These and further features of the present invention will be apparent with reference to the following description and drawing, wherein.

Figure 1:
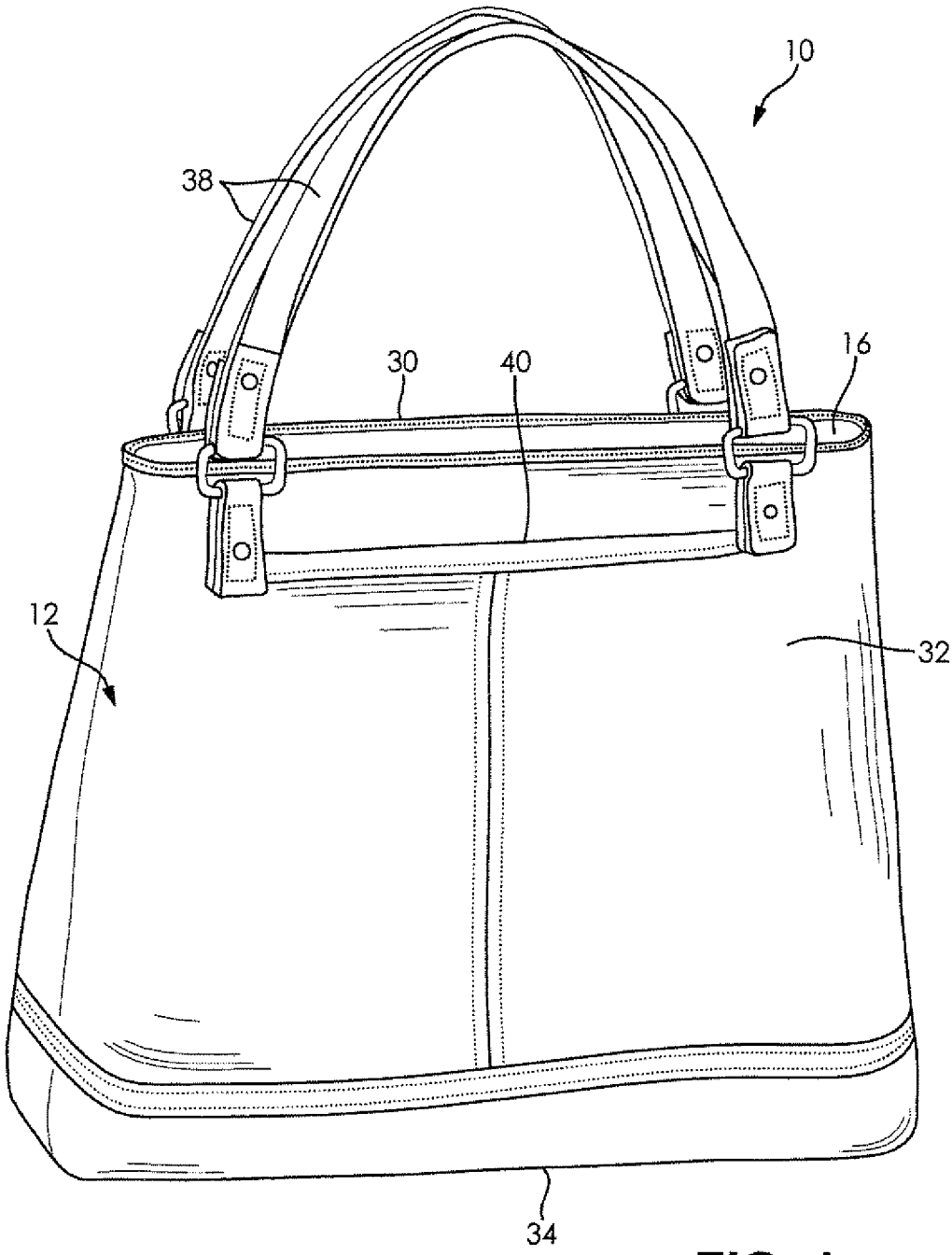
FIG. 1 is a perspective view of a handbag according to a first embodiment of the present invention.
Figure 2:
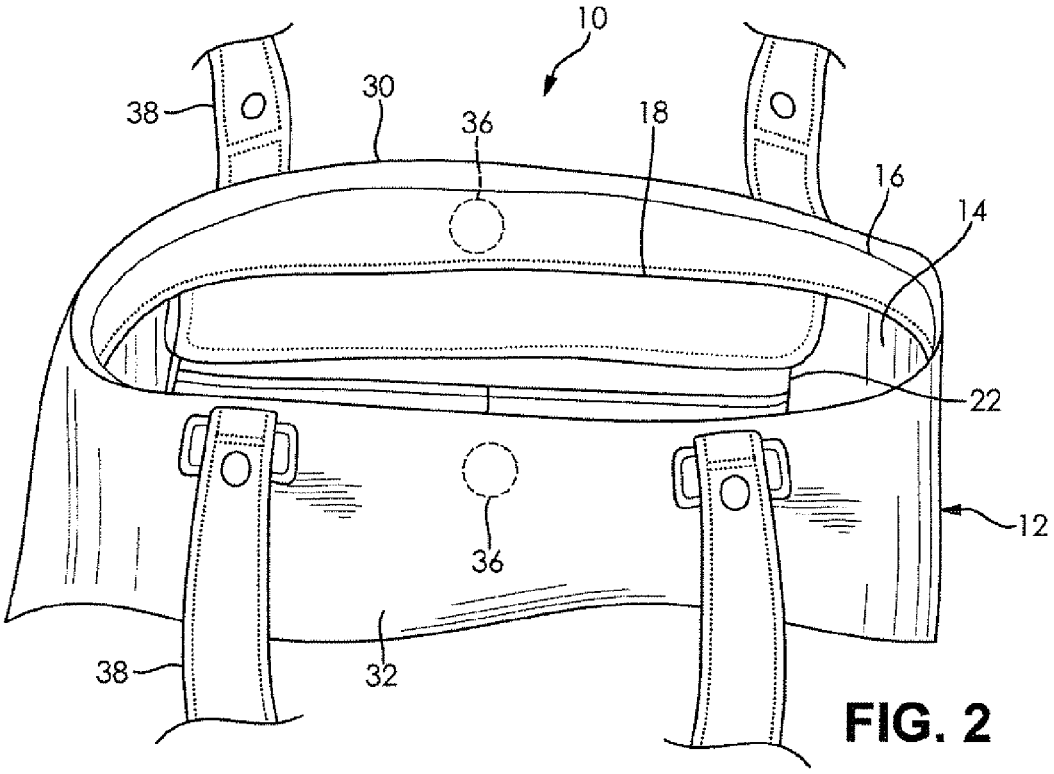
FIG. 2 is a fragmented perspective view looking into the open top of the handbag of FIG. 1.

It should be understood that the appended drawings are not necessarily to scale, presenting a somewhat simplified representation of various preferred features illustrative of the basic principles of the invention. The specific design features of the handbags as disclosed herein, including, for example, specific dimensions and shapes of the various components will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the handbags illustrated in the drawings. In general, up or upward refers to an upward direction within the plane of the paper in FIG. 1 and down or downward refers to a downward direction within the plane of the paper in FIG. 1. Also in general, front or forward refers to a direction out of the plane of the paper in FIG. 1 and rear or rearward refers to a direction facing into the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved handbags and pocket systems disclosed herein. The following detailed discussion of various alternative embodiments will illustrate the general principles of the invention. Other embodiments suitable for other applications will be apparent to those skilled in the art given the benefit of this disclosure.

FIGS. 1 to 4 illustrate a handbag 10 according to the present invention. The illustrated handbag 10 includes a body 12 forming an interior compartment 14 and an opening 16 for accessing the interior compartment 14, a first hanger 18 secured to the body 12 within the interior compartment 14, a second hanger 20 secured to the body 12 within the interior compartment 14, a first pocket assembly 22 removably secured to the first hanger 18 with a plurality of first fasteners 24 so that the first pocket assembly 22 hangs from the first hanger 18 within the interior compartment 14 and is accessible through the opening 16, and a second pocket assembly 26 removably secured to the second hanger 20 with a plurality of second fasteners 28 so that the second pocket assembly 26 hangs from the second hanger 20 within the interior compartment 14 and is accessible through the opening 16. The term "handbag" is used in this specification and the claims to mean a container used for carrying money, small personal items or accessories, or the like (especially by women) including, but not limited to, athletic bags baguette bags, barrel bags, bowling bags, bucket bags, clutches, doctor's bags, duffel bags, evening bags, feed bags, handbags, hobo bags, messenger bags, pocketbooks, pouches, purses, saddle bags, satchels, shoulder bags, sling bags, totes, weekend bags, and the like.

The illustrated body 12 includes a first or rear side 30 and a second or front side 32 which cooperate to form the opposed front and rear sides of the interior compartment 14. The illustrated body 12 also includes base or bottom 34 that forms a lower side of the interior compartment 14. The illustrated interior compartment 14 is closed except for the top opening 16 formed by the body 12 but other suitable configurations can be utilized. The interior compartment 14 is sized in any desired manner for storing personal items. The illustrated body 12 is provided with fasteners 36 for removably closing the opening 16 (best shown in FIG. 2). The illustrated fasteners 36 are embedded magnets but any other suitable removable fasteners can alternatively be utilized such as, for example, buckles, buttons, clips, hook and loop fasteners (such as Velcro), snaps, straps, ties, turn locks, zippers, and the like. The body 12 can be formed in any suitable manner such as, for example, the illustrated plurality of panels and can be secured together in any suitable manner such as, for example, the illustrated stitching. The illustrated body 12 is provided with a pair of handles 38. One of the handles 38 is secured to the first side 30 and the other handle 38 is secured to the other side 32. It is noted that the illustrated handles 38 can be eliminated, have a different size or shape, or be located at different locations on the body 12 and/or other quantities of handles 38 can be utilized if desired. The illustrated body 12 is also provided with an exterior pocket 40 formed on the exterior of the front side 32. It is noted that the illustrated exterior pocket 40 can be eliminated, have a different size or shape, or be located at a different location on the body 12 and/or more than one exterior pocket 40 can be utilized if desired. The body 12 can comprise any suitable materials such as canvas, cloth, fabric, natural or synthetic leather, polymers and the like.

The illustrated first and second hangers 18, 20 are spaced apart about a periphery of the interior compartment 14. The illustrated first and second hangers 18, 20 are secured to the body 12 within the interior compartment 14 with the first hanger 18 secured to the first side 30 and centrally located in the lateral direction on the first side 30 and near the opening 16 and the second hanger 20 secured to the second side 32 and centrally located in the lateral direction on the second side 32 and near the opening 16. Secured in this manner, the illustrated first and second hangers 18, 20 are located on the opposed sides 30, 32 of the internal compartment 14. It is noted that the first and second hangers 18, 20 can be secured in other suitable locations within the interior compartment 14 and there can alternatively be any other suitable quantity of hangers 18, 20 within the interior compartment 14. For example, there could by only one hanger 18, 20 or more than two hangers 18, 20 and/or the first and second hangers 18, 20 could alternatively be located on the same side of a relatively wide handbag 10.

Figure 5:
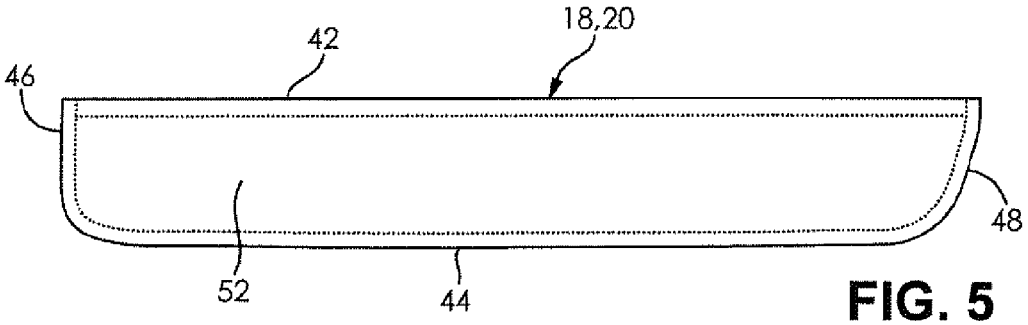
FIG. 5 is a front elevational view of hanger of the handbag of FIG. 1.
Figure 6:
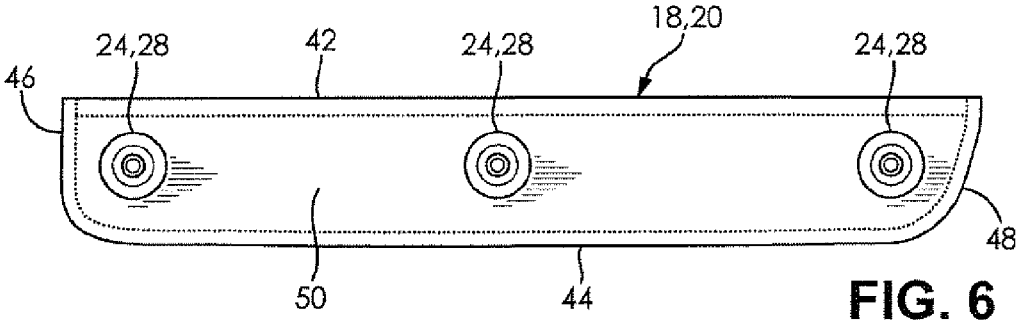
FIG. 6 is a rear elevational view of the hanger of FIG. 5.
Figure 3:
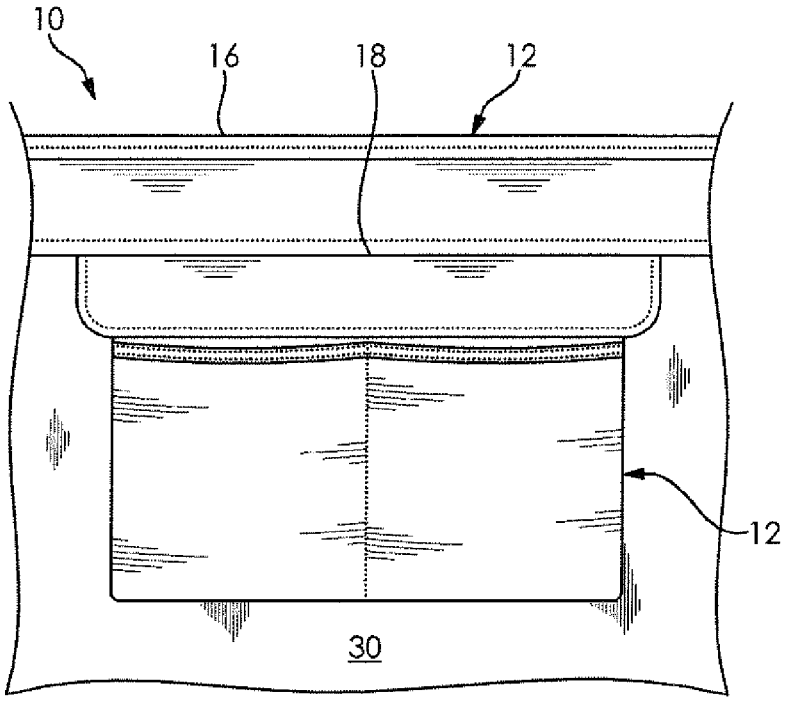
FIG. 3 is an enlarged, fragmented elevation al view of an interior of the handbag of FIG. 1 showing a first pocket assembly removably secured to a first hanger.
Figure 4:
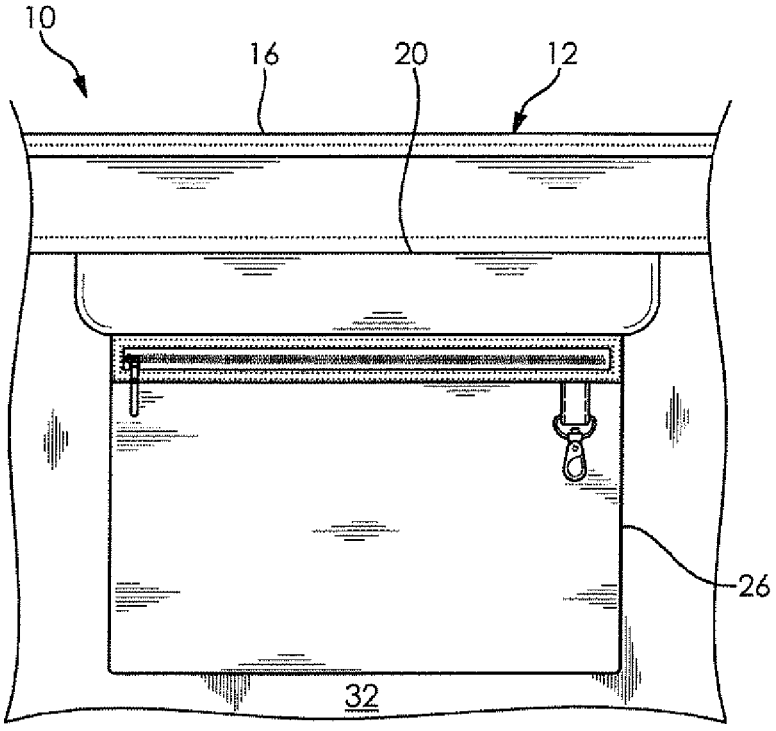
FIG. 4 is another enlarged, fragmented elevation al view of the interior of the handbag of FIG. 1 showing a second pocket assembly removably secured to a second hanger.

FIGS. 5 and 6 show just the illustrated first hanger 18 but the illustrated first and second hangers 18, 20 are the same. It is noted that the first and second hangers 18, 20 can alternatively be configured in different manners but the configuration of the removable fasteners 24, 28 should be the same so that any of the pocket assembles 22, 26 can be selectively secured thereto. The illustrated first and second hangers 18, 20 are each rectangular shaped having generally horizontal, spaced-apart and parallel upper and lower edges 42, 44 and generally vertical, spaced-apart and parallel left and right end edges 46, 48 connecting the upper and lower edges 42, 44. The illustrated first and second hangers 18, 20 are provided with the first and second removable fasteners 24, 28 respectively. The illustrated first and second removable fasteners 24, 28 are each snaps that cooperate with snaps secured to the pocket assemblies 22, 26 as described in more detail herein above. The illustrated first and second hangers 18, 20 each have a male portion of a snap which cooperate with a female portion of a snap located on the pocket assemblies 22, 26 but it is noted that the male and female portions of the snaps can be reversed if desired or can alternatively have a combination of male and female portions. The illustrated first and second hangers 18, 20 each have three equally spaced apart removable fasteners 24, 28 along the length of the hangers 18, 20 with one removable fastener 24, 28 located near the right end of the hanger 18, 20, one removable fastener 24, 28 located near the left end of the hanger 18, 20, and one of the removable fasteners 24, 28 centrally located therebetween. It is noted however that any other suitable quantity and/or configuration of the removable fasteners 24, 28 can alternatively be utilized. The removable fasteners 24, 28 are located on the outer or rear side 50 of the illustrated first and second hangers 18, 20 so that they are located between the hanger 18, 20 and the body side 30, 32. The illustrated first and second hangers 19, 20 include at least two layers of material so that the fasteners 24, 28 such as the illustrated snaps are not visible from the inner or front side 52 (best shown in FIGS. 2 and 5). It is noted that alternatively the removable fasteners 24, 28 can be located on the inner or front side 52 or the removable fasteners 24, 28 can be visible on the inner or front side 52 when the fasteners 24, 28 are located on the outer or rear side 50. It is also noted that the removable fasteners 24, 28 can alternatively be any other suitable type of removable fastener such as, for example, buckles, buttons, clips, hook and loop fasteners (such as Velcro), magnets, straps, ties, turn locks, zippers, and the like. The hangers 18, 20 can comprise any suitable materials such as canvas, cloth, fabric, natural or synthetic leather, polymers, and the like.

Figure 7:
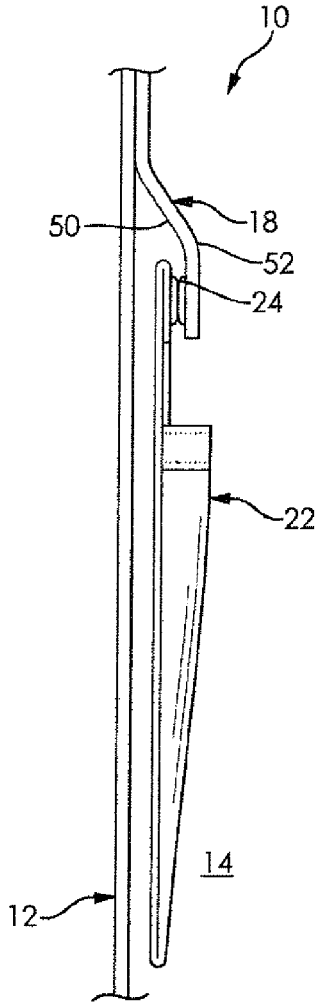
FIG. 7 an enlarged, fragmented side elevational view of the first hanger and the first pocket assembly of FIG. 5.

The illustrated first and second hangers 18, 20 are each secured to the body 12 near their tops or upper edges 42 so that the hangers 18, 20 hang downward like flaps supported by their tops and the lower edges 44 are generally pivotable upward about the upper edge 42 (best shown in FIG. 7). The illustrated first and second hangers 18, 20 are each sewn to the body 12 near the upper edge 42 but can alternatively be secured to the body 12 in any other suitable manner.

Figure 8:
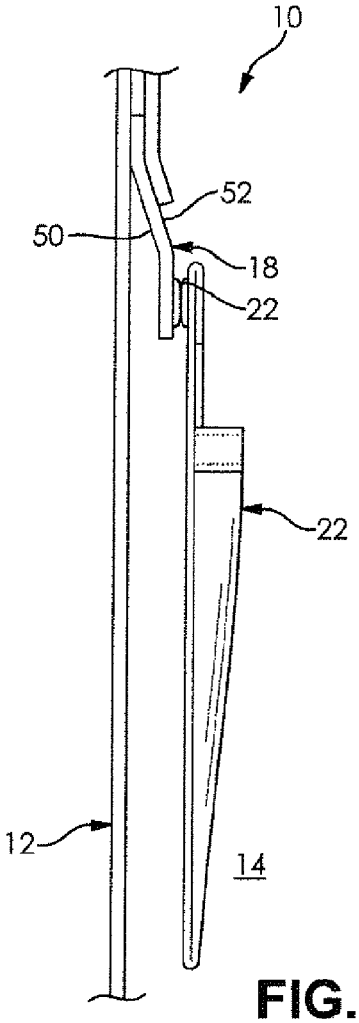
FIG. 8 is an enlarged, fragmented side elevational view similar to FIG. 8 but showing a first variation of the first hanger and the first pocket assembly wherein the pocket assembly is removably secured over the hanger rather than under the hanger.
Figure 9:
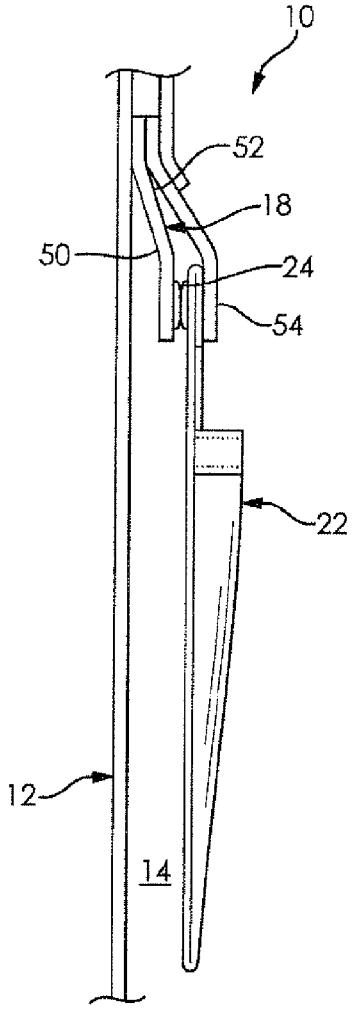
FIG. 9 is an enlarged, fragmented side elevational view similar to FIG. 8 but showing a second variation of the first hanger and the first pocket assembly wherein a cover flap is provided to hide the fasteners on the first hanger when one of the pocket assemblies is not secured to the first hanger.

The illustrated first and second pocket systems 22, 26 are removably secured to and supported by only the first and second hangers 18, 20 respectively with the pocket assemblies 22, 26 hanging downward from the hangers 18, 20 (best shown in FIG. 7). The illustrated first pocket assembly 22 is secured underneath or behind the first hanger 18, that is adjacent to the outer or rear side 50 of the first hanger 18, so that the first pocket assembly 22 is secured to the first hanger 18 between the body 12 and the first hanger 18 and the second pocket assembly 26 is removably secured underneath or behind the second hanger 20, that is adjacent to the outer or rear side 50 of the second hanger 20, so that the second pocket assembly 26 is removably secured to the second hanger 20 between the body 12 and the second hanger 20. It is noted however that the pocket assemblies 22, 26 can alternatively be removably secured to the inner or front sides 52 of the hangers 18, 20 when the hangers 18, 20 and pocket assemblies 22, 26 are configured to do so (best shown in FIG. 8). It is preferred to have the removable fasteners 24, 28 on the outer or rear side of the hangers 50 so that they are not visible within the handbag 10 when one of the pocket assemblies 22, 26 is not secured thereto. It is noted however that other methods of hiding the removable fasteners 24, 28 on the hangers 18, 20 can be utilized such as, for example, an inner cover flap 54 (best shown in FIG. 9) or in the case of snaps, snap covers can be snapped onto the snaps when not being utilized to secure one of the pocket assemblies 22, 26.

Figure 10A:
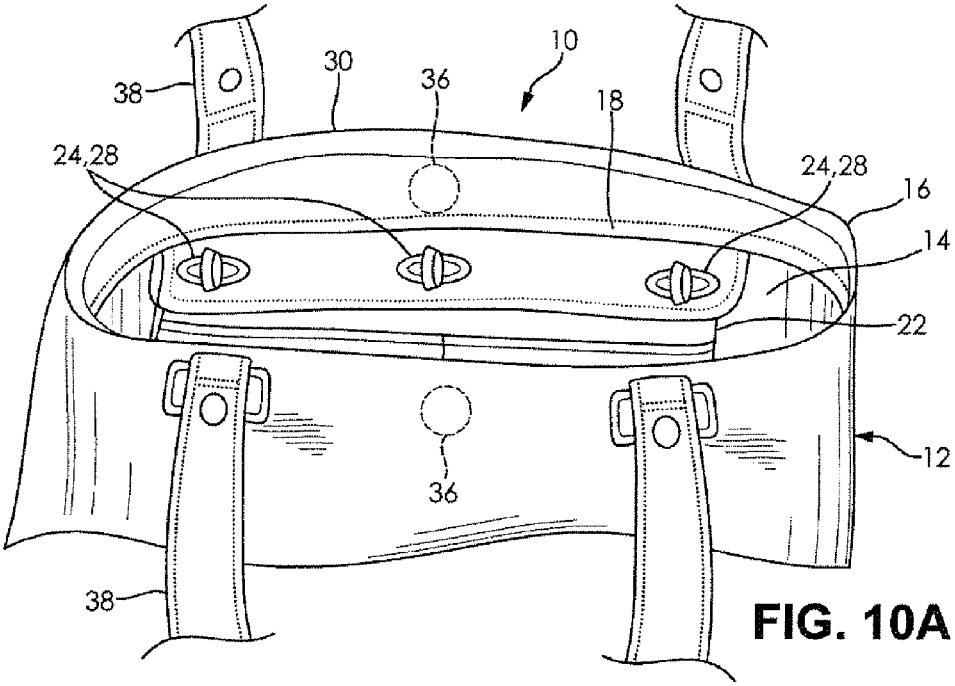
FIG. 10A is a fragmented perspective view looking into the open top of the handbag similar to FIG. 2 but wherein the removable fasteners are turn locks with cooperating eyelets rather than snaps.
Figure 10B:
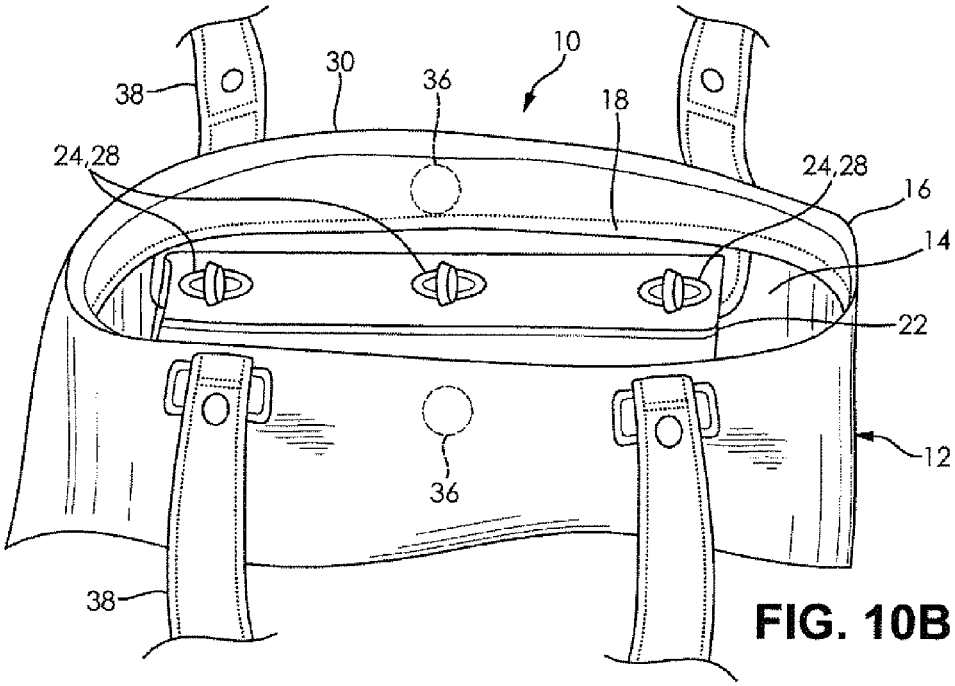
FIG. 10B is a fragmented perspective view looking into the open top of the handbag similar to FIG. 10A but wherein the pocket assembly is removably secured over the hanger rather than under the hanger.
Figure 11:
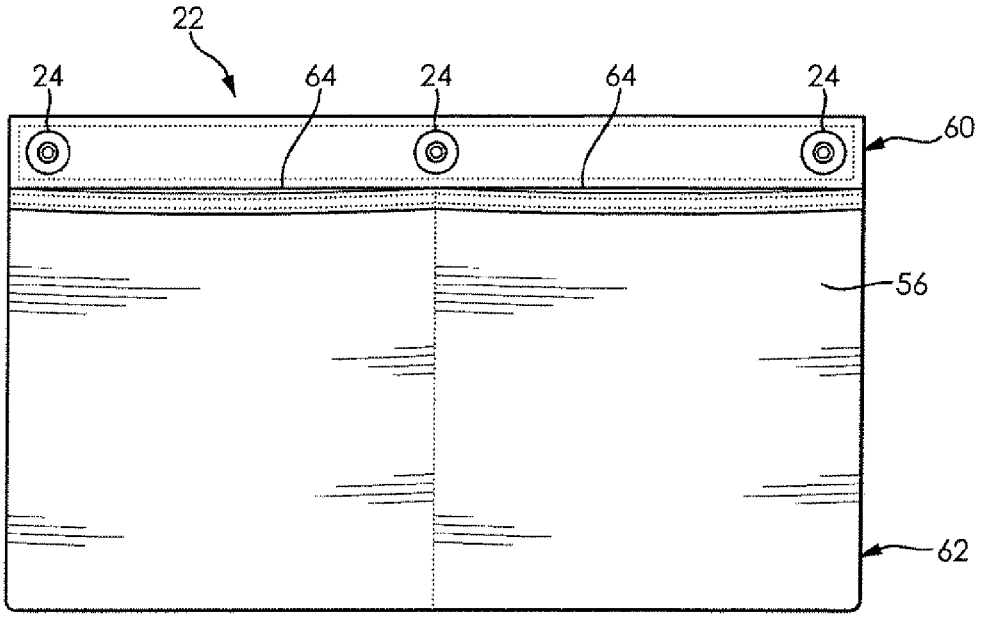
FIG. 11 is an enlarged, front elevational view of the first pocket assembly of the handbag of FIG. 1.
Figure 12:
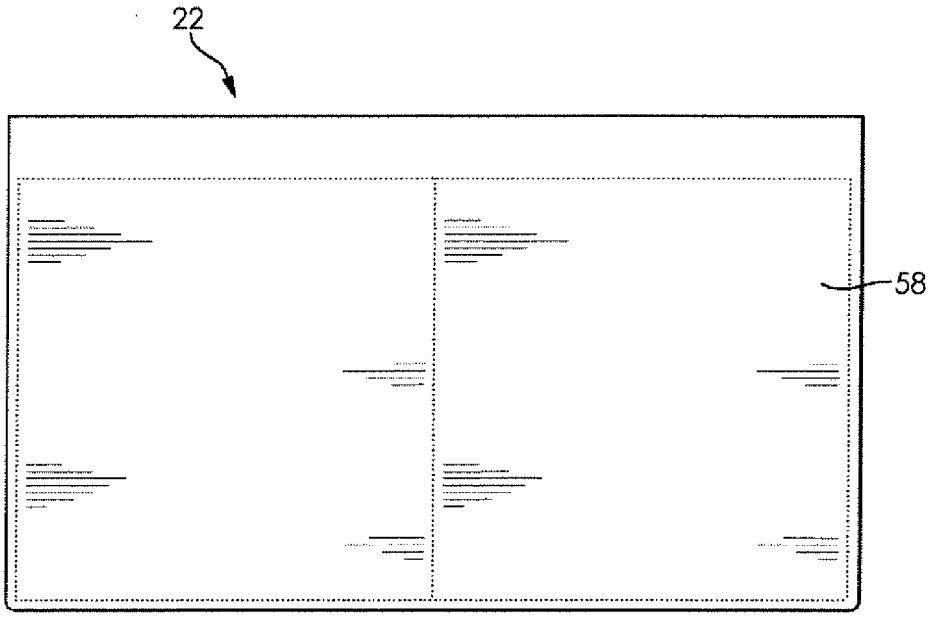
FIG. 12 is a rear elevational view of the first pocket assembly of FIG. 11.
Figure 13:
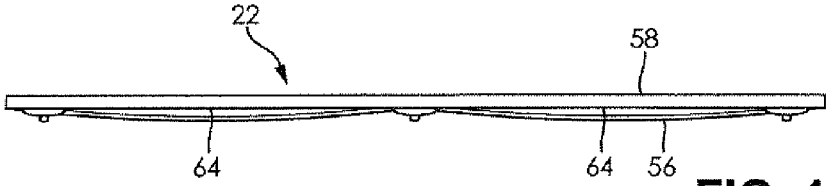
FIG. 13 is a top plan view of the first pocket assembly of FIGS. 11 and 12.
Figure 14:
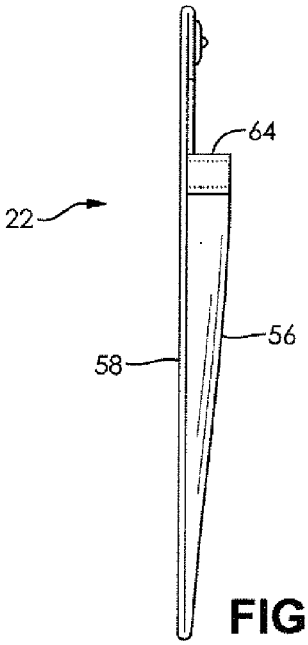
FIG. 14 is a side elevational view of the first pocket assembly of FIGS. 11 to 13.

FIG. 10A shows that the removable fasteners 24, 28 can be of other suitable types. In this variation, the illustrated removable fasteners 24, 28 are turn locks rather than above-illustrated snaps. The illustrated first pocket assembly 22 has the turning portion of the turn lock while the first hanger 18 has the eyelet portion of the turn lock so that the first pocket assembly 22 is removably secured to the outer or rear side 50 of the first hanger 18. FIG. 10B illustrates that the portions of the turn lock can be reversed if desired. The illustrated first pocket assembly 22 has the eyelet portion of the turn lock while the first hanger 18 has the turning portion of the turn lock so that the first pocket system 22 is secured to the inner or front side 52 of the first hanger 18.

FIGS. 11 to 14 show the illustrated first pocket assembly 22 having a generally rectangular shape with front and rear sides 56, 58. The illustrated first pocket assembly 22 includes a hanger or attachment portion 60 configured to cooperate with the hangers 18, 20 and a storage or pocket portion 62 located below the hanger portion 60. The illustrated hanger portion 60 is sized, shaped and configured to cooperate with the hangers 18, 20 of the handbag body 12. The illustrated hanger portion 60 is provided with three spaced apart removable fasteners 24, 28 in the form of female snap portions to cooperate with the male snap portions of the hangers 18, 20 so that the first pocket assembly 22 can be removably secured to either of the hanger assemblies 18, 20. The illustrated fastener assemblies 24, 28 are located on the front side 56 of the pocket assembly 22 to engage the rear or outer side 52 of the hangers 18, 20. It is noted that the hanger portion 60 can be configured in any other suitable manner to cooperate with the hangers 18, 20 for removably securing the first pocket assembly 22 to the hangers 18, 20. The illustrated storage portion 62 is provided with a pair of side-by-side and contiguous pockets 64. The illustrated pockets 64 are open at their tops and sized to hold and store desired personal items. If desired, the pockets 64 can be provided with suitable removable fasteners for selectively closing the open tops. It is noted that the pockets 64 can alternatively have any other suitable configuration and/or there can alternatively be any other suitable quantity of the pockets 64 such as one or three or more pockets 64. The first pocket assembly 22 can comprise any suitable materials such as canvas, cloth, fabric, natural or synthetic leather, polymers, and the like.

Figure 15:
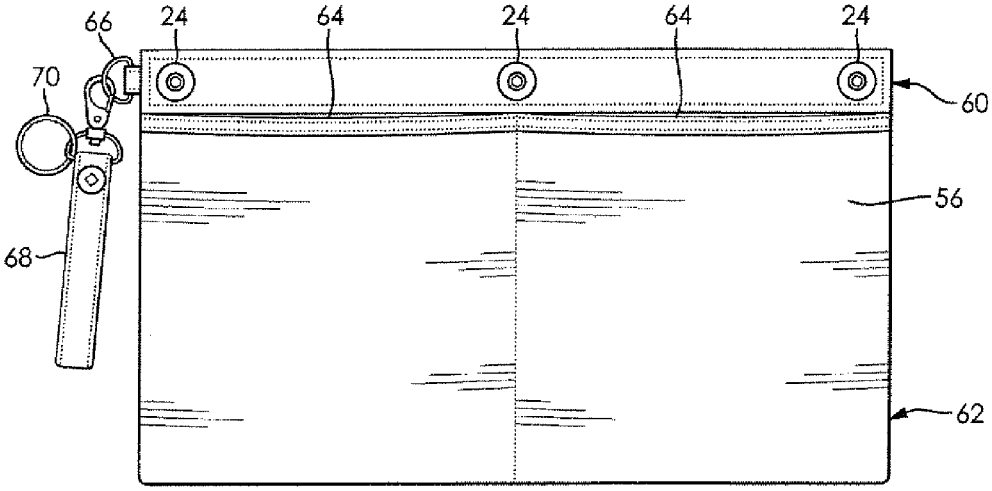
FIG. 15 is an enlarged, front elevational view of the first pocket assembly of FIG. 11 but configured so that it can be utilized when unsecured to the handbag.
Figure 16:
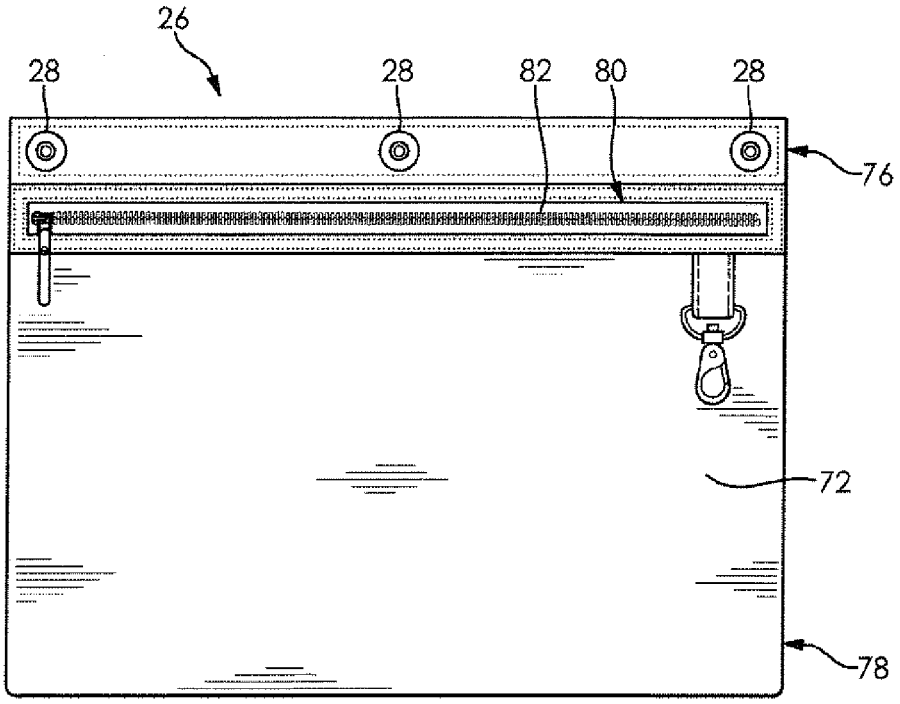
FIG. 16 is an enlarged, front elevational view of the second pocket assembly of the handbag of FIG. 1.
Figure 17:
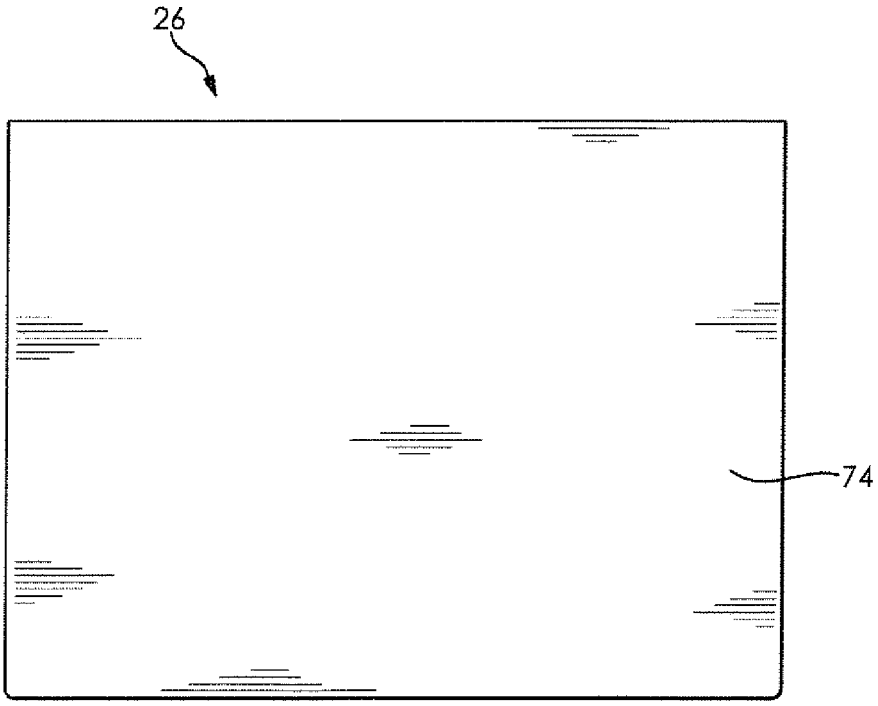
FIG. 17 is a rear elevational view of the second pocket assembly of FIG. 16.
Figure 18:
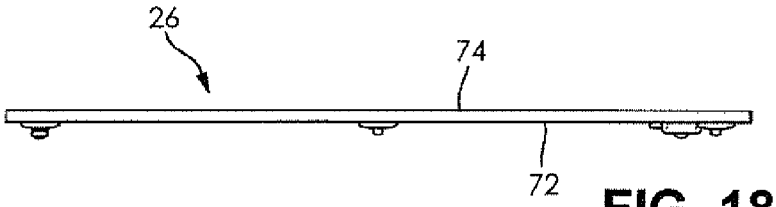
FIG. 18 is a top plan view of the second pocket assembly of FIGS. 16 and 17.
Figure 19:
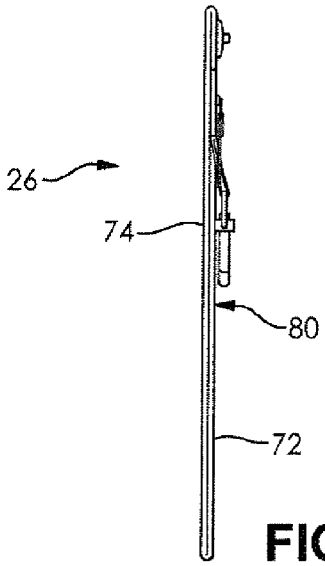
FIG. 19 is a side elevational view of the second pocket assembly of FIGS. 16 to 18.

FIG. 15 illustrates a variation of the first pocket assembly 22 wherein an end of the hanger portion 60 is provided with an attachment 66 in the form of a D-ring and a wrist strap or handle 68 is removable secured thereto. The wrist strap 68 enables the first pocket assembly 22 to be independently used when not secured within the handbag 10. It is noted that the wrist strap 68 and its attachment 66 can alternatively have any other suitable configuration. The illustrated wrist strap 68 is also provided with a key ring 70 which enables keys to be removable secured to the first pocket assembly 22 whether secured within the handbag 10 or not.

FIGS. 16 to 19 show the illustrated second pocket assembly 26 having a generally rectangular shape with front and rear sides 72, 74. The illustrated second pocket assembly 26 includes a hanger or attachment portion 76 configured to cooperate with the hangers 18, 20 and a storage or pocket portion 78 located below the hanger portion 76. The illustrated hanger portion 76 is sized, shaped and configured to cooperate with the hangers 18, 20 of the handbag body 12. The illustrated hanger portion 76 is provided with three spaced apart removable fasteners 24, 28 in the form of female snap portions to cooperate with the male snap portions of the illustrated hangers 18, 20 so that the second pocket assembly 26 can be removably secured to either of the hangers 18, 20. The illustrated fastener assemblies 24, 28 are located on the front side 72 of the second pocket assembly 26 to engage the rear or outer side 50 of the hangers 18, 20. It is noted that the hanger portion 76 can be configured in any other suitable manner to cooperate with the hangers 18, 20 for removably securing the second pocket assembly 26 to the hangers 18, 20. The illustrated storage portion 78 is provided with a single pocket 80. The illustrated pocket 80 is open at its top and sized to hold and store desired personal items. The top opening of the illustrated pocket 80 is provided with removable fastener 82 in the form of a zipper for selectively closing the open top. It is noted that the pocket 80 can alternatively have any other suitable configuration and/or there can alternatively be any other suitable quantity of the pocket 80 such as two or more pockets. The second pocket assembly 26 can comprise any suitable materials such as canvas, cloth, fabric, natural or synthetic leather, polymers, and the like.

Figure 20:
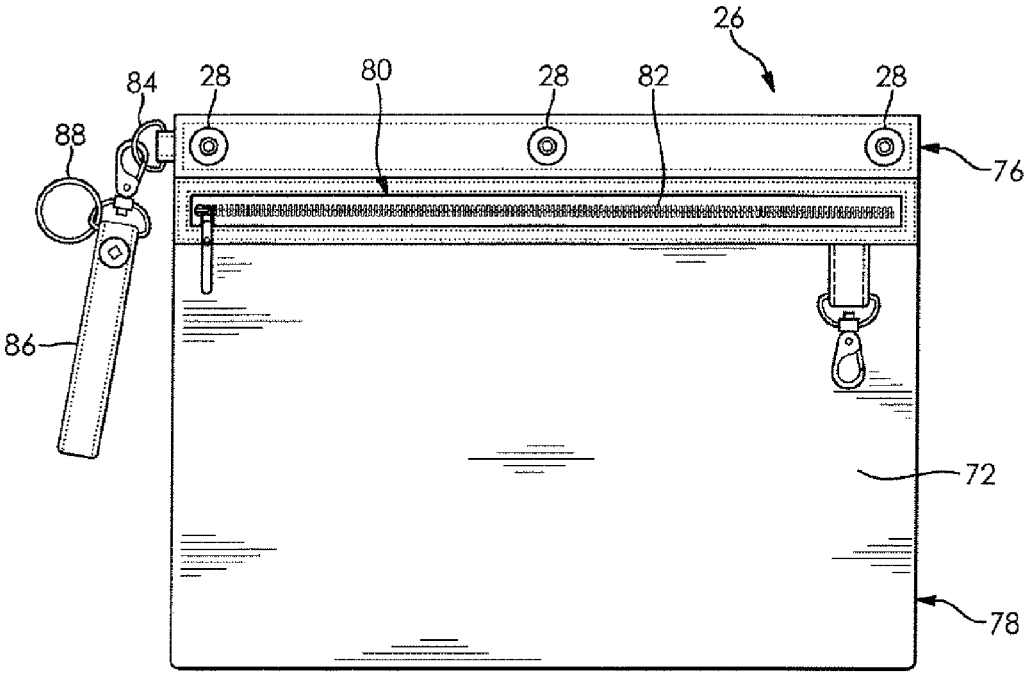
FIG. 20 is an enlarged, front elevational view of the second pocket assembly of FIG. 16 but configured so that it can be utilized when unsecured to the handbag.
Figure 21:
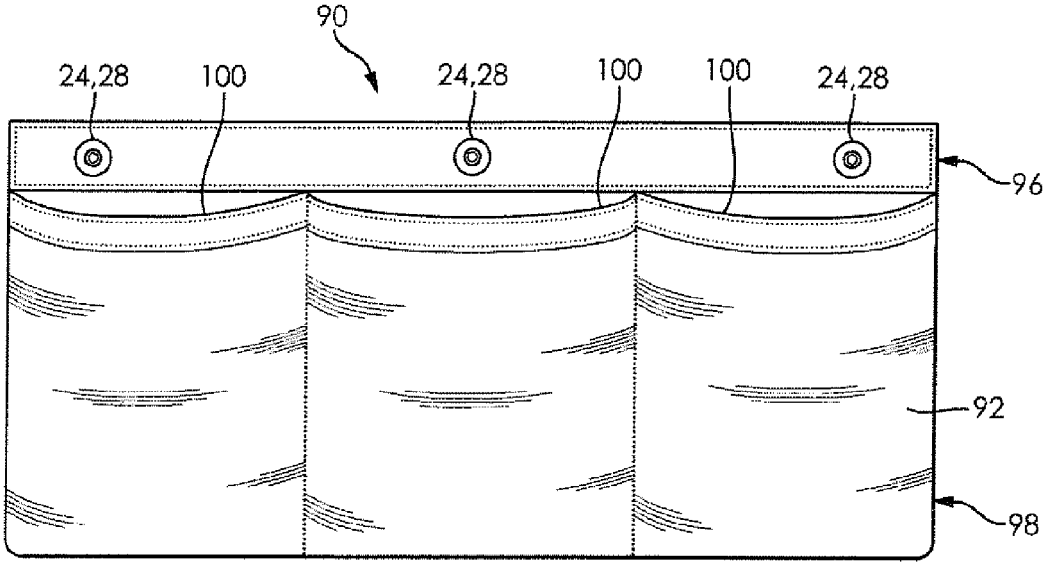
FIG. 21 is an enlarged, front elevational view of a third pocket assembly for use with the handbag of FIG. 1.
Figure 22:
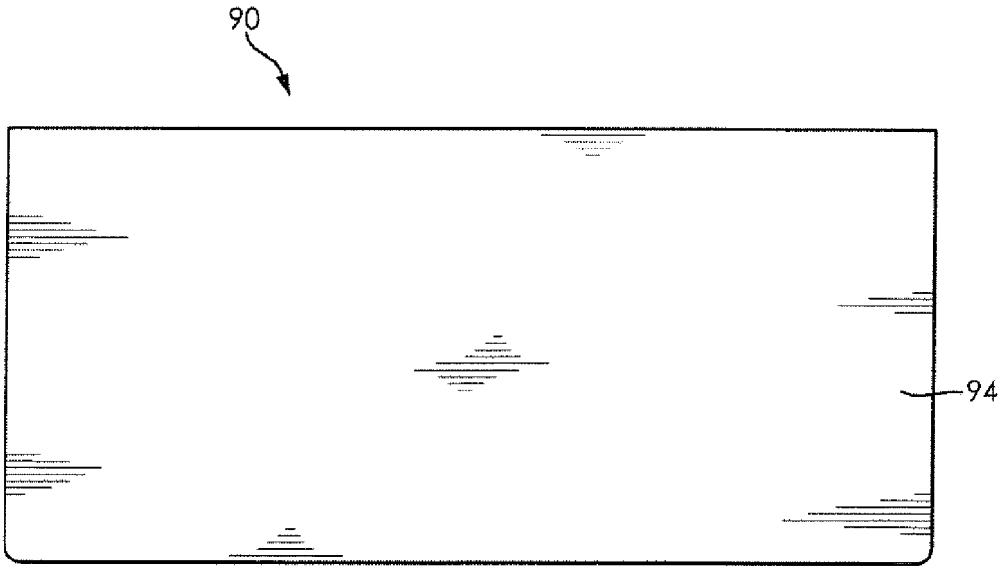
FIG. 22 is a rear elevational view of the third pocket assembly of FIG. 21.
Figure 23:
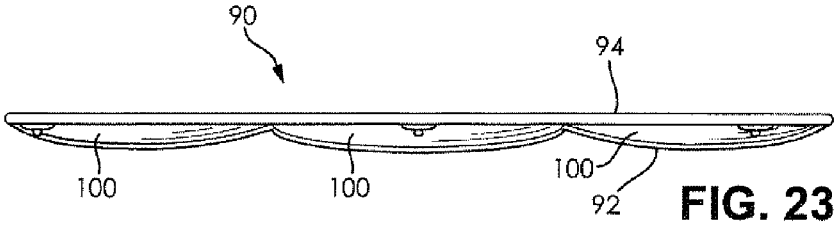
FIG. 23 is a top plan view of the third pocket assembly of FIGS. 21 and 22.
Figure 24:
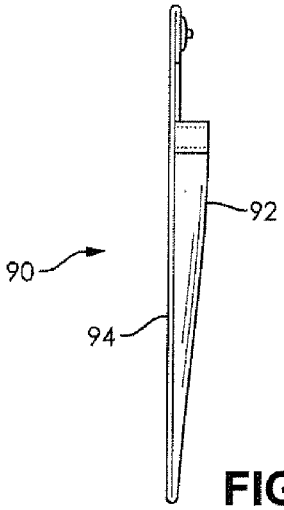
FIG. 24 is a side elevational view of the third pocket assembly of FIGS. 21 to 23.

FIG. 20 illustrates a variation of the second pocket assembly wherein an end of the hanger portion 76 is provided with an attachment 84 in the form of a D-ring and a wrist strap or handle 86 is removable secured thereto. The wrist strap 86 enables the second pocket assembly 26 to be independently used when not secured within the handbag 10. It is noted that the wrist strap 86 and its attachment 88 can alternatively have any other suitable configuration. The illustrated wrist strap 86 is also provided with a key ring 88 which enables keys to be removable secured to the second pocket assembly 26 whether secured within the handbag 10 or not.

FIGS. 21 to 24 show a third pocket assembly 90 having a generally rectangular shape with front and rear sides 92, 94. The third pocket assembly 90 illustrates that there can be additional pocket assemblies 22, 26, 90. Preferably there are more pocket assemblies 22, 26, 90 (each with a different configuration) than there are hangers 18, 20 so that the different pocket assemblies 22, 26, 90 can be selectively secured to the hangers 18, 20 to provide a desired configuration within the interior compartment 14 of the handbag 10. The illustrated third pocket assembly 90 includes a hanger or attachment portion 96 configured to cooperate with the hangers 18, 20 and a storage or pocket portion 98 located below the hanger portion 96. The illustrated hanger portion 96 is sized, shaped and configured to cooperate with the hangers 18, 20 of the handbag body 12. The illustrated hanger portion 96 is provided with three spaced apart removable fasteners 24, 28 in the form of female snap portions to cooperate with the male snap portions of the illustrated hangers 18, 20 so that the third pocket assembly 90 can be removably secured to either of the hangers 18, 20. The illustrated fastener assemblies 24, 28 are located on the front side of the pocket assembly 92 to engage the rear or outer side 50 of the illustrated hangers 18, 20. It is noted that the hanger portion 96 can be configured in any other suitable manner to cooperate with the hangers 18, 20 for removably securing the third pocket assembly 90 to the hangers 18, 20. The illustrated storage portion 98 is provided with three side-by-side and contiguous pockets 100. The illustrated pockets 100 are open at their tops and sized to hold and store desired personal items. If desired, the pockets 100 can be provided with suitable removable fasteners for selectively closing the open tops. It is noted that the pockets 100 can alternatively have any other suitable configuration and/or there can alternatively be any other suitable quantity of the pockets 100 such as four or more pockets 100. The third pocket assembly 90 can comprise any suitable materials such as canvas, cloth, fabric, natural or synthetic leather, polymers, and the like.

Figure 25:
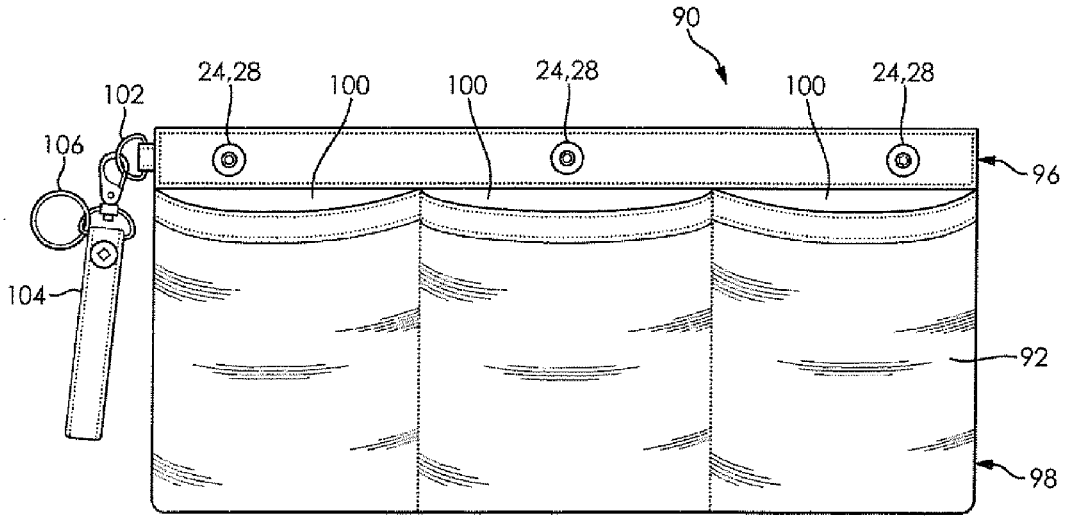
FIG. 25 is an enlarged, front elevational view of the third pocket assembly of FIG. 21 but configured so that it can be utilized when unsecured to the handbag.

FIG. 25 illustrates a variation of the third pocket assembly 90 wherein an end of the hanger portion 96 is provided with an attachment 102 in the form of a D-ring 102 and a wrist strap or handle 104 is removable secured thereto. The wrist strap 104 enables the third pocket assembly 90 to be independently used when not secured within the handbag 10. It is noted that the wrist strap 104 and its attachment 102 can alternatively have any other suitable configuration. The illustrated wrist strap 104 is also provided with a key ring 106 which enables keys to be removable secured to the third pocket assembly 90 whether secured within the handbag 10 or not.

Figure 26:
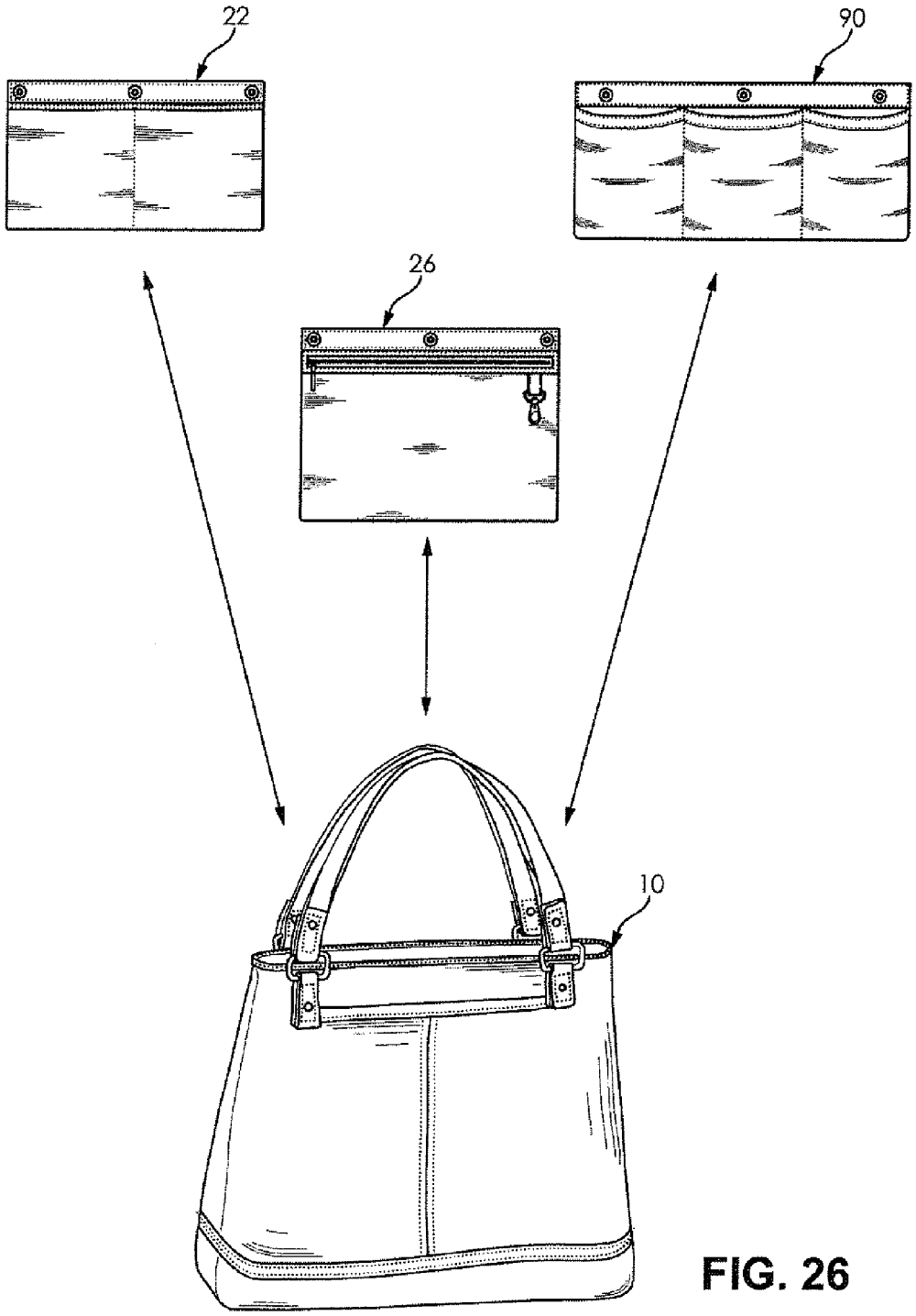
FIG. 26 is graphic view showing the first, second, and third pocket assemblies can be interchangeably secured with the handbag of FIG. 1.
Figure 27:
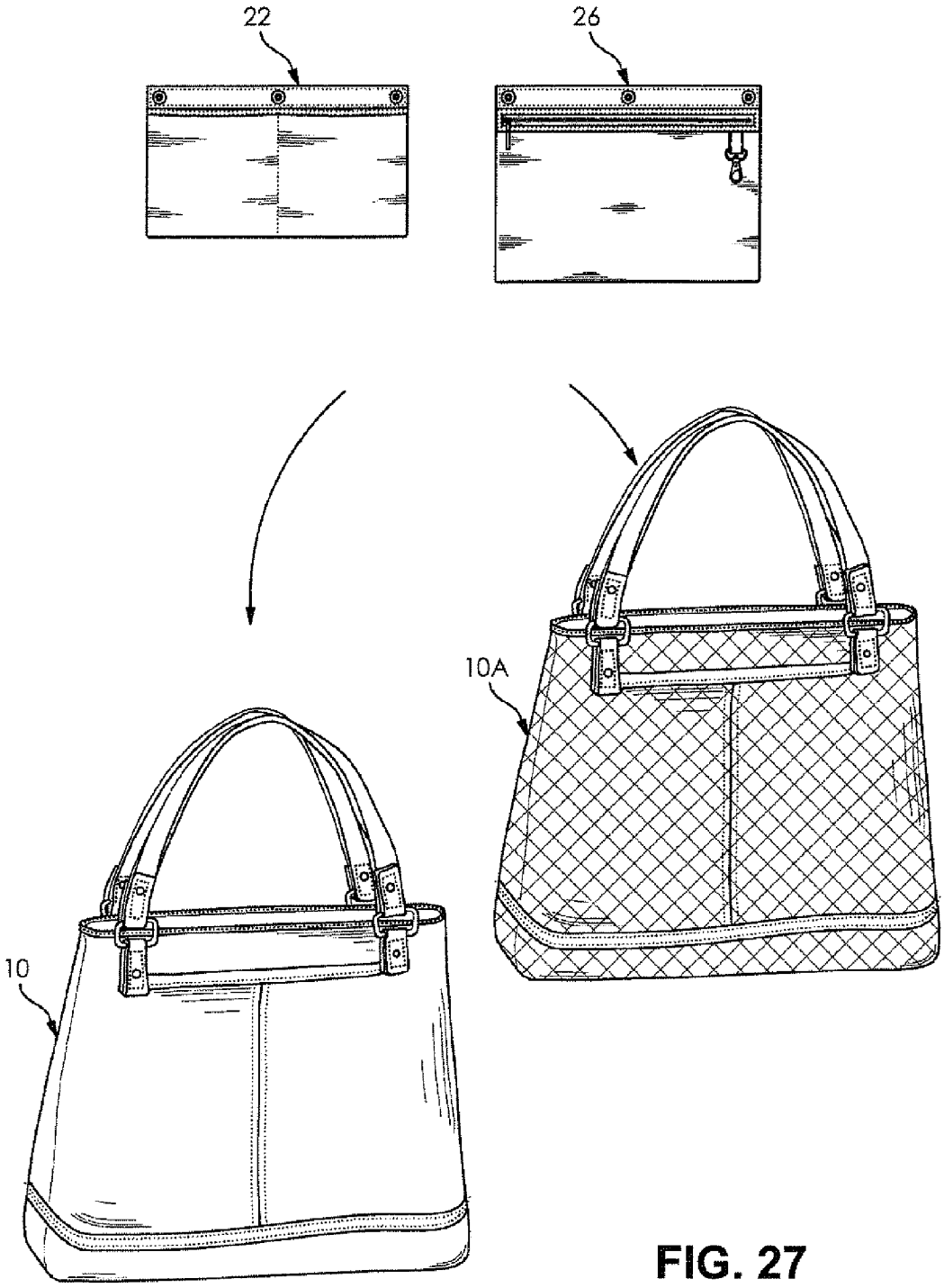
FIG. 27 is a graphic view showing the first and second pocket assemblies can be interchangeably secured within the handbag of FIG. 1 and a second handbag.

It is noted that there can be any desired quantity of pocket assemblies 22, 26, 90 having different configurations. For example, additional pocket assemblies can be configured for holding and storing cards such as credit cards, business cards etc, MP3 players such as, for example, iPods, cellular telephones such as, for example, iPhones, tablet computer such as, for example, iPads, or any other desired configuration. FIG. 26 shows that each of the various pocket assemblies 22, 26, 90 can be selectively secured and removed from the handbag 10 to provide a desired configuration for the interior compartment 14 of the handbag 10. This is possible because each of the hanger portions 60, 76, 96 of the pocket assemblies 22, 26, 90 are configured to cooperate with each of hangers 18, 20 and are provided with removable fasteners 24, 28 that cooperate with the removable fasteners 24, 28 of each of the hangers 18, 20. FIG. 27 shows that one or more of the pocket assemblies 22, 26 from the handbag 10 can be easily removed and secured to a second handbag 10A having a similar hangers 18, 20 but a different exterior aesthetic design so that personal items within the pocket assemblies 22, 26 can be easily moved between the handbags 10, 10A.

Any of the features or attributes of the above described embodiments and variations can be used in combination with any of the other features and attributes of the above described embodiments and variations as desired.

From the foregoing disclosure it will be apparent that the present invention provides an improved handbag and handbag system which enables a single handbag to be easily configured and reconfigured to have a desired interior configuration. Additionally, the hand bag and handbag system enables personal items to be easily moved between handbags when it is desired to have a handbag having a different exterior appearance by simply moving any of the pocket assemblies loaded with the personal items.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A handbag comprising, in combination:

a body forming an interior compartment and an opening for accessing the interior compartment;

a first hanger sewn to the body only near an upper edge of the first hanger so that a free lower edge of the first hanger hangs downward in a direction away from the opening within the interior compartment and selectively pivots upward about the upper edge;

a second hanger sewn to the body only near an upper edge of the second hanger so that a free lower edge of the second hanger hangs downward in a direction away from the opening within the interior compartment and selectively pivots upward about the upper edge;

wherein the body has opposed first and second sides, and the first hanger is centrally secured to the first side and the second hanger is centrally secured to the second side opposed to the first hanger;

a first pocket assembly having front and rear sides, a hanger portion configured to cooperate with the first hanger, a storage portion located below the hanger portion, and at least one first pocket for storage located on the front side of the storage portion and having a top opening;

wherein the hanger portion of the first pocket assembly is removably secured to the first hanger with a plurality of first snaps so that the first pocket assembly hangs down from the first hanger within the interior compartment away from the opening of the body with the front side facing inward into the interior compartment of the body and with the top opening of the first pocket facing upward toward the opening of the body, and so that the top opening of the first pocket is accessible through the opening of the body when the first pocket assembly is hanging down from and supported by the first hanger within the interior compartment when removably secured to the first hanger assembly;

wherein the first pocket assembly is secured to the first hanger only near the free lower edge of the first hanger so that the first pocket assembly freely hangs from and pivots with the first hanger within the interior compartment and is secured to the body only by the pivoting first hanger so that the first pocket assembly is supported only by the pivoting first hanger within the interior compartment when removably secured to the first hanger assembly;

a second pocket assembly having front and rear sides, a hanger portion configured to cooperate with the second hanger, a storage portion located below the hanger portion, and at least one second pocket for storage located on the front side of the storage portion and having a top opening;

wherein the hanger portion of the second pocket assembly is removably secured to the second hanger with a plurality of second snaps so that the second pocket assembly hangs down from the second hanger within the interior compartment away from the opening of the body with the front side facing inward into the interior compartment and with the top opening of the second pocket facing upward toward the opening of the body, and so that the top opening of the second pocket is accessible through the opening of the body when the second pocket assembly is hanging down from the second hanger within the interior compartment when removably secured to the second hanger assembly;

wherein the second pocket assembly is secured to the second hanger only near the free lower edge of the second hanger so that the second pocket assembly freely hangs from and pivots with the second hanger within the interior compartment and is secured to the body only by the pivoting second hanger so that the second pocket assembly is supported only by the pivoting second hanger within the interior compartment when removably secured to the second hanger assembly;

wherein the hanger portion of the first pocket assembly is secured over the first hanger within the interior compartment so that the hanger portion of the first pocket assembly is secured to the first hanger opposite the body with the first hanger located between the body and the hanger portion of the first pocket assembly within the interior compartment, and the hanger portion of the second pocket assembly is secured over the second hanger within the interior compartment so that the hanger portion of the second pocket assembly is secured to the second hanger opposite the body with the second hanger located between the body and hanger portion of the second pocket assembly within the interior compartment;

wherein the first hanger-is configured so that the plurality of first snaps on the first hanger is not visible when the first pocket assembly is removed from the first hanger, and wherein the second hanger is configured so that the plurality of second snaps on the second hanger is not visible when the second pocket assembly is removed from the second hanger; and a first cover flap secured to the body near an upper edge of the first cover flap so that a free lower edge of the first cover flap hangs downward in a direction away from the opening with the first hanger located between the first cover flap and the body within the interior compartment to cover the first hanger within the interior compartment, and a second cover flap secured to the body near an upper edge of the second cover flap so that a free lower edge of the second cover flap hangs downward in a direction away from the opening with the second hanger located between the second cover flap and the body within the interior compartment to cover the second hanger within the interior compartment.

2. The handbag according to claim 1, wherein the first and second hangers are within the interior compartment near the opening.

3. The handbag according to claim 2, wherein the first and second hangers are spaced apart about a periphery of the interior compartment.

4. The handbag according to claim 1, wherein the first and second hangers are each rectangular shaped having the upper edge and the lower edge and the first and second hangers are each secured to the body near the upper edge so that the lower edge is generally pivotable upward about the upper edge.

5. The handbag according to claim 1, wherein the first pocket assembly is secured to the first hanger with three of the snaps spaced apart along the first hanger and the second pocket assembly is secured to the second hanger with three of the snaps spaced apart along the second hanger.

6. The handbag according to claim 1, wherein at least one of the first hanger and the first pocket assembly is configured so that the plurality of first snaps on the first pocket assembly is not visible when the first pocket assembly is secured to the first hanger, and wherein at least one of the second hanger and the second pocket assembly is configured so that the plurality of second snaps on the second pocket assembly is not visible when the second pocket assembly is secured to the second hanger.

7. A handbag system comprising, in combination:

a handbag comprising:

a body forming an interior compartment and an opening for accessing the interior compartment;

a first hanger sewn to the body only near an upper edge of the first hanger so that a free lower edge of the first hanger hangs downward in a direction away from the opening within the interior compartment and selectively pivots upward about the upper edge;

a second hanger sewn to the body only near an upper edge of the second hanger so that a free lower edge of the second hanger hangs downward in a direction away from the opening within the interior compartment and selectively pivots upward about the upper edge;

wherein the body has opposed first and second sides, and the first hanger is centrally secured to the first side and the second hanger is centrally secured to the second side opposed to the first hanger;

first, second, and third pocket assemblies each having front and rear sides, a hanger portion configured to cooperate with the first and second hangers, a storage portion located below the hanger portion, and at least one pocket for storage and having a top opening;

wherein the first, second, and third pocket assemblies are interchangeably secured to the first hanger to hang down from the first hanger within the interior compartment in a direction away from the opening of the body with the front side facing inward into the interior compartment of the body, and with the top opening of the pocket facing upward toward the opening of the body so that the top opening of the pocket is accessible through the opening of the body when hanging down from the first hanger within the interior compartment, and are interchangeably secured to the second hanger to hang down from the second hanger within the interior compartment in a direction away from the opening of the body with the front side facing inward into the interior compartment of the body, and with the top opening of the pocket facing upward toward the opening of the body so that the top opening of the pocket is accessible through the opening of the body when hanging down from the first hanger within the interior compartment;

wherein the first, second, and third pocket assemblies are each interchangeably secured to the first hanger only near the free low edge of the first hanger to freely hang down from and pivot with the first hanger within the interior compartment and secured to the body only by the pivoting first hanger to be supported only by the pivoting first hanger within the interior compartment when removably secured to the first hanger assembly, and to the second hanger only near the free low edge of the second hanger to freely hang down from the second hanger within the interior compartment and secured to the body only by the pivoting second hanger to be supported only by the pivoting second hanger within the interior compartment when removably secured to the second hanger assembly;

wherein the first and second hangers and the first, second, and third pocket assemblies are interchangeably secured to each the first hanger and the second hanger with cooperating snaps;

wherein the hanger portions of the first second, and third pocket assemblies are interchangeably secured over the first hanger within the interior compartment so that the hanger portions of the first second, and third pocket assemblies are interchangeably secured to the first hanger opposite the body with the first hanger located between the body and the hanger portion of the attached one of the first, second, and third pocket assemblies within the interior compartment, and wherein the hanger portions of the first second, and third pocket assemblies are interchangeably secured over the second hanger so that the hanger portions of the first second, and third pocket assemblies are interchangeably secured to the second hanger opposite the body with the second hanger located between the body and the hanger portion of the attached one of the first, second, and third pocket assemblies within the interior compartment wherein the first hanger is configured so that the plurality of first snaps on the first hanger is not visible when the of the first second, and third pocket assemblies are removed from the first hanger, and wherein the second hanger is configured so that the plurality of second snaps on the second hanger is not visible when the of the first second, and third pocket assemblies are removed from the second hanger; and a first cover flap secured to the body near an upper edge of the first cover flap so that a free lower edge of the first cover flap hangs downward in a direction away from the opening with the first hanger located between the first cover flap and the body within the interior compartment to cover the first hanger within the interior compartment, and a second cover flap secured to the body near an upper edge of the second cover flap so that a free lower edge of the second cover flap hangs downward in a direction away from the opening with the second hanger located between the second cover flap and the body within the interior compartment to cover the second hanger within the interior compartment.

8. The handbag according to claim 7, wherein the first and second hangers are spaced apart about a periphery of the interior compartment.

9. The handbag according to claim 7, wherein the first and second hangers are each rectangular shaped having the upper edge and the lower edge and the first and second hangers are each secured to the body near the upper edge so that the lower edge is generally pivotable upward about the upper edge.

10. The handbag according to claim 7, wherein at least one of the first hanger and the first second, and third pocket assemblies is configured so that the plurality of snaps of the first second, and third pocket assemblies is not visible when one of the of the first second, and third pocket assemblies is interchangeably secured to the first hanger, and wherein at least one of the second hanger and the first second, and third pocket assemblies is configured so that the plurality of snaps of the first second, and third pocket assemblies is not visible when one of the of the first second, and third pocket assemblies is interchangeably secured to the second hanger.

11. A handbag comprising, in combination:

a body forming an interior compartment and an opening for accessing the interior compartment;

a rectangular-shaped first hanger having upper and lower edges and sewn to the body near the opening and only near the upper edge of the first hanger so that the first hanger hangs downward away from the opening within the interior compartment and selectively pivots upward about the upper edge;

a rectangular-shaped second hanger having upper and lower edges and sewn to the body near the opening and only near the upper edge of the second hanger so that the second hanger hangs downward away from the opening within the interior compartment and selectively pivots upward about the upper edge;

wherein the body has opposed first and second sides, and the first hanger is centrally secured to the first side and the second hanger is centrally secured to the second side opposed to the first hanger;

a first pocket assembly having front and rear sides, a hanger portion configured to cooperate with the first hanger, a storage portion located below the hanger portion, and at least one first pocket for storage located on the front side of the storage portion and having a top opening;

wherein the hanger portion of the first pocket assembly is removably secured to the first hanger with a plurality of first snaps so that the first pocket assembly hangs down from the first hanger within the interior compartment away from the opening of the body with the front side facing inward into the interior compartment of the body and with the top opening of the first pocket facing upward toward the opening of the body, and so that the top opening of the first pocket is accessible through the opening of the body when the first pocket assembly is hanging down from the first hanger within the interior compartment;

wherein the first pocket assembly is secured to the first hanger only near the free lower edge of the first hanger so that the first pocket assembly freely hangs from and pivots with the first hanger within the interior compartment and is secured to the body only by the pivoting first hanger so that the first pocket assembly is supported only by the pivoting first hanger within the interior compartment;

a second pocket assembly having front and rear sides, a hanger portion configured to cooperate with the first hanger, a storage portion located below the hanger portion, and at least one second pocket for storage located on the front side of the storage portion and having a top opening;

wherein the hanger portion of the second pocket assembly is removably secured to the second hanger with a plurality of second snaps so that the second pocket assembly hangs down from the second hanger within the interior compartment away from the opening of the body with the front side facing inward into the interior compartment of the body and with the top opening of the second pocket facing upward toward the opening of the body, and so that the top opening of the first pocket is accessible through the opening of the body when the second pocket assembly is hanging down from the second hanger within the interior compartment;

wherein the second pocket assembly is secured to the second hanger only near the free lower edge of the second hanger so that the second pocket assembly freely hangs from and pivots with the second hanger within the interior compartment and is secured to the body only by the pivoting second hanger so that the second pocket assembly is supported only by the pivoting second hanger within the interior compartment;

wherein the hanger portion of the first pocket assembly is secured over the first hanger within the interior compartment so that the hanger portion of the first pocket assembly is secured to the first hanger opposite the body with the first hanger located between the body and the hanger portion of the first pocket assembly within the interior compartment, and the hanger portion of the second pocket assembly is secured over the second hanger within the interior compartment so that the hanger portion of the second pocket assembly is secured to the second hanger opposite the body with the second hanger located between the body and hanger portion of the second pocket assembly within the interior compartment; and a first cover flap secured to the body near an upper edge of the first cover flap so that a free lower edge of the first cover flap hangs downward in a direction away from the opening with the first hanger located between the first cover flap and the body within the interior compartment to cover the first hanger within the interior compartment, and a second cover flap secured to the body near an upper edge of the second cover flap so that a free lower edge of the second cover flap hangs downward in a direction away from the opening with the second hanger located between the second cover flap and the body within the interior compartment to cover the second hanger within the interior compartment.

12. The handbag according to claim 11, wherein at least one of the first hanger and the first pocket assembly is configured so that the plurality of first snaps on the first pocket assembly is not visible when the first pocket assembly is secured to the first hanger, wherein at least one of the second hanger and the second pocket assembly is configured so that the plurality of second snaps on the second pocket assembly is not visible when the second pocket assembly is secured to the second hanger.

13. The handbag according to claim 11, wherein the first hanger is configured so that the plurality of first snaps on the first hanger assembly is not visible when the first pocket assembly is removed from the first hanger, and wherein the second hanger is configured so that the plurality of second snaps on the second hanger assembly is not visible when the second pocket assembly is removed from the second hanger.

* * * * *